US007710271B2

(12) United States Patent
Frumau

(10) Patent No.: US 7,710,271 B2
(45) Date of Patent: May 4, 2010

(54) METHOD AND SYSTEM FOR LIGHTING CONTROL

(75) Inventor: Constantinus Carolus Franciscus Frumau, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 184 days.

(21) Appl. No.: 11/912,165

(22) PCT Filed: Apr. 19, 2006

(86) PCT No.: PCT/IB2006/051207

§ 371 (c)(1),
(2), (4) Date: Oct. 22, 2007

(87) PCT Pub. No.: WO2006/111927

PCT Pub. Date: Oct. 26, 2006

(65) Prior Publication Data

US 2008/0197782 A1 Aug. 21, 2008

(30) Foreign Application Priority Data

Apr. 22, 2005 (EP) ..... 05103292

(51) Int. Cl.
*G08B 13/14* (2006.01)

(52) U.S. Cl. ..... 340/572.1; 315/151; 250/227.21

(58) Field of Classification Search ... 340/572.1–572.8, 340/825.21, 825.52, 10.1, 10.4, 10.42, 10.52; 250/214 R, 227.21, 227.22; 362/227, 233, 362/319, 800

See application file for complete search history.

(56) References Cited

U.S. PATENT DOCUMENTS

| | | | | |
|---|---|---|---|---|
| 5,382,947 | A * | 1/1995 | Thaler et al. | 340/825.22 |
| 6,333,605 | B1 | 12/2001 | Grouev et al. | |
| 6,567,032 | B1 * | 5/2003 | Mullaly et al. | 341/176 |
| 7,024,119 | B1 * | 4/2006 | Mier-Langner et al. | 398/106 |
| 7,307,542 | B1 * | 12/2007 | Chandler et al. | 340/825.52 |
| 2004/0160199 | A1 | 8/2004 | Morgan et al. | |
| 2008/0203928 | A1 * | 8/2008 | Frumau et al. | 315/151 |

FOREIGN PATENT DOCUMENTS

| | | | |
|---|---|---|---|
| DE | 10113170 | A1 | 9/2002 |
| WO | 0213490 | A2 | 2/2002 |
| WO | 03027942 | A1 | 4/2003 |
| WO | 03078894 | A1 | 9/2003 |
| WO | 2004057927 | A1 | 7/2004 |

* cited by examiner

*Primary Examiner*—Douglas W Owens
*Assistant Examiner*—Jimmy T Vu
(74) *Attorney, Agent, or Firm*—Thorne & Halajian, LLP

(57) ABSTRACT

A method and a system control at least one lighting arrangement, in which the lighting arrangement modulates the light it emits by lighting arrangement data that contains an identification code identifying the lighting arrangement. A user control device is suitable to receive the light from the lighting arrangement and to derive therefrom the lighting arrangement data. The user controlled device measures a property of the received light, apart from it representing data, to provide additional data which is associated with the lighting arrangement which is associated with the identification code contained in the received data. Data about a location of the user control device is determined, the user controlled device transmits the data it gained, and a main control device is suitable to receive the data transmitted by the user control device and to control the at least one lighting arrangement dependent on all the data.

20 Claims, 2 Drawing Sheets

METHOD AND SYSTEM FOR LIGHTING CONTROL

FIELD OF THE INVENTION

The invention relates to a method for controlling a lighting system.

BACKGROUND OF THE INVENTION

WO 2004/057927 discloses a method for configuration a wireless controlled lighting system. The prior art system comprises a central master control device, several local control master devices, which are linked to the central master device, and, associated with each local control master device, one or more lighting units and a portable remote control. Each lighting unit and the portable control are linked to their associated local control master device by a wireless connection. Light emitted by a lighting unit is modulated by an identification code, which was stored in the lighting unit before controlling the lighting unit. The portable control is suitable to receive the modulated light and to derive therefrom the identification code of the source lighting device. The portable control has a user interface by which a user can enter additional data, which is sent to its associated local control master device together with the identification code received from a lighting unit. Said additional data may contain an indication of a switch or key which the user assigns to the lighting unit to operate the lighting unit from then on, such as for turning on or off. Then, the data is communicated to the central master device for general lighting management.

With the prior art method and system the control of lighting units is carried out by forward control only, that is, without any kind of feedback about actual lighting conditions and locations of the lighting units. For example, an object can be illuminated by any number of lighting units directly, but also indirectly as a result of reflections. With the prior art system it is not possible to measure lighting effects caused by different lighting units on an object and to change controlling of the lighting units dependent on the measured lighting effects.

OBJECT OF THE INVENTION

It is an object of the invention to solve the drawbacks of the prior art and to provide an improvement thereof.

In particular, it is an object of the invention to measure lighting effects caused by the operation of different lighting units on their environment and to control said operation dependent on the measured effects.

SUMMARY OF THE INVENTION

The above object of the invention is achieved by a method where the property of the light is measured and can be any of several properties of the light, for example intensity of composite of light, intensities of light of different colors and emission directions. With said method a user can easily design, apply, redesign, and so on, a lighting scheme dependent on data of light sources and locations where specific effects are wanted.

Preferably, at the lighting arrangement, lighting arrangement data is comprised with data of at least one property, apart from the identification code, of the lighting arrangement. Accordingly, the main control device is informed about the properties or specifications of a lighting arrangement, such as about its power and its time and temperature dependent light emission, so that the central control device can take this in account when controlling the lighting arrangement, in particular concurrent with the controlling of other lighting arrangements.

Preferably, at the main control device, the lighting arrangement is controlled in concordance with a control program, a scheme of light effects to be generated by the light arrangement and the data received from the user control device and associated with the lighting arrangement. Accordingly, upon being provided with a control program and a scheme of wanted light effects and data received from the user controlled device, the main control device can control the lighting arrangements without additional support or input from a user.

In particular, said at least one light property of a lighting arrangement is determined at the lighting arrangement itself and data representing said property is transmitted by modulating light emitted by it, which data is then relayed by the user control device to the main control device. The light property data can be fixed, that is, stored in advance in the lighting arrangement, or the property may be measured by the lighting arrangement at suitable times to provide such data.

Preferably, said at least one light property of a lighting arrangement is measured at the user control device. As a consequence, properties of light emitted by different lighting arrangements are measured according to identical standards and measures and means for determining light properties at the lighting arrangements can be reduced.

Preferably, dependent on said data received by it, the main control device controls the at least one lighting arrangement to maintain a lighting effect, which said at least one lighting arrangement has on the user controllable device. As a result, a user may drag a lighting effect, such as a light spot, just by moving the user control device through the area covered by the lighting arrangement or the lighting arrangements.

Preferably, before controlling said at least one lighting arrangement, the main control device is provided with a priori data about a lighting effect said at least one lighting arrangement has at several locations, and during said controlling the main control device takes said a priori data in account. By doing so, at the time of controlling a lighting arrangement, the burden to determine light properties thereof can be reduced to just one time, that is, before the lighting arrangement is put in actual use.

Preferably, before controlling said at least one lighting arrangement, the main control device is provided with a priori data about an environment which can be lighted by said at least one lighting arrangement, and during said controlling the main control device takes said a priori data in account. Any lighting arrangement will have limited lighting coverage of objects. The arrangement will effect different intensities of light and shadows at different locations. By providing the main control device with data about such entities the main control device can take this in account when controlling different lighting arrangements, in particular for concurrently obtaining and/or maintaining specific lighting effects at different locations.

BRIEF DESCRIPTION OF THE DRAWINGS

The invention will become more gradually apparent from the following exemplary description in connection with the accompanying drawings, in which.

DETAILED DESCRIPTION OF EMBODIMENTS

Figure 1:
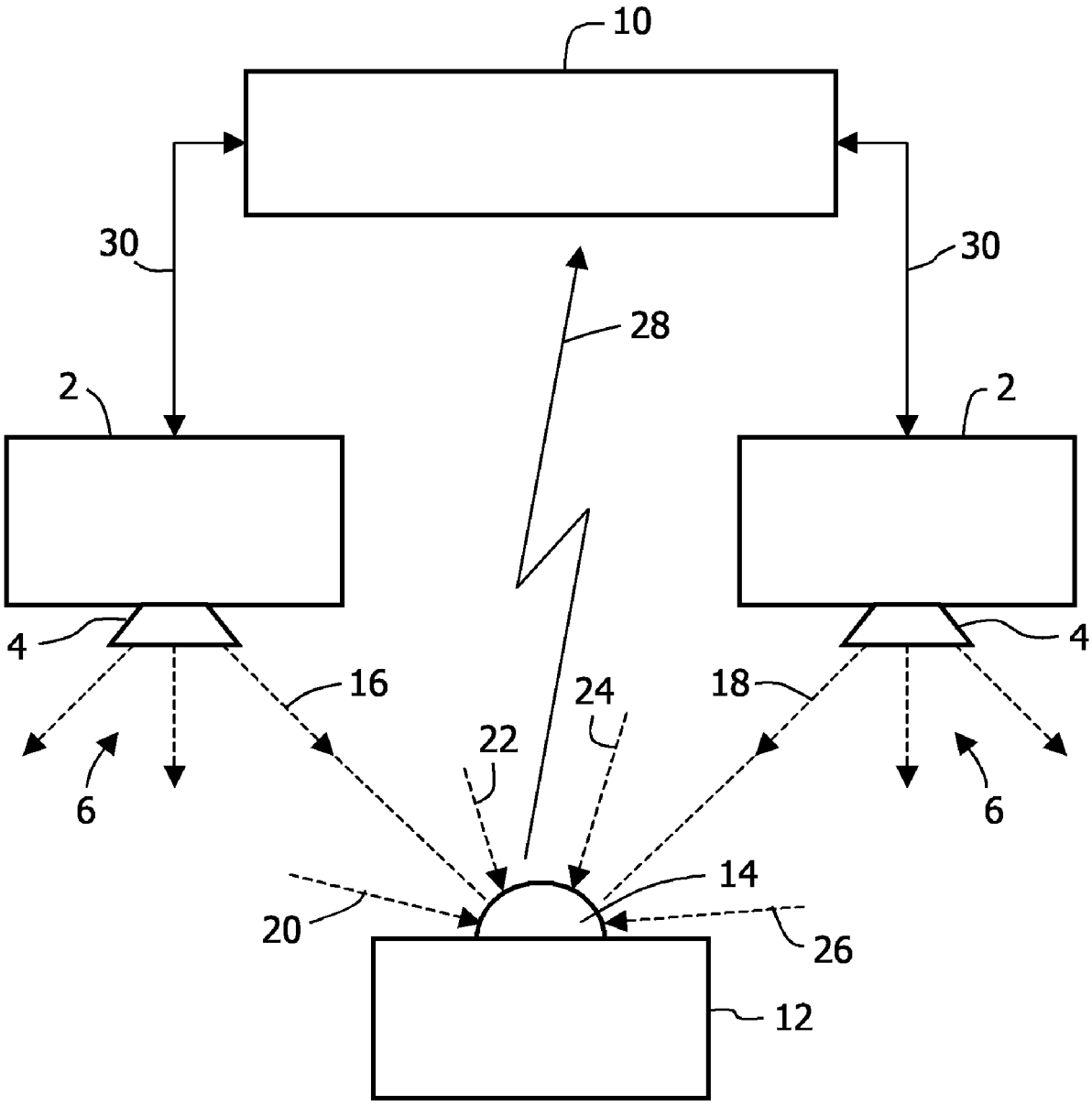
FIG. 1 shows a block diagram of a control system according to the invention in which the method according to the invention is applied.

The system shown in FIG. 1 comprises one or more lighting arrangements 2, which may each comprise one or more lighting units, each lighting unit being schematically indicated by reference numeral 4. Lighting units 4 associated with a lighting arrangement 2 may be arranged at different locations in a room or in some other area to be lighted. Light emitted by a lighting unit 4 is indicated by a group of dashed arrows 6.

A lighting arrangement 2 comprises means, for storing an identification code, which is unique for the lighting arrangement 2, control means for supplying the lighting unit 4, and means for modulating the supply of a lighting unit 4 and therewith modulating the light output of the lighting unit 4, dependent on data, which at least comprises said identification code.

The system shown in FIG. 1 further comprises a main control device 10 and a user control device 12. In particular, the user control device 12 is a hand held device, which is portable by a user. The user control device 12 is provided with light sensing means, of which a light entrance dome 14 is shown only, which is suitable to receive light from its environment, that is, from one or more lighting units 4, either directly or indirectly after reflection on objects such as walls. Arrows 16 and 18 indicate light which the user control device 12 receives from different lighting units 4. Arrows 20-26 indicate light which is received by the user control device 12 from other lighting units 4 and/or other sources, possibly by reflection.

The user control device 12 can communicate with the main control device 10 via a wireless connection, which is indicated by reference numeral 28.

Each lighting arrangement 2 is connected to the main control device 10 via a link 30, which can be of any type.

The main control device 10 contains a processor, which runs a control program in concordance with a scheme for lighting locations covered by the lighting units 4 of the lighting arrangements 2, such as for light intensity, light color range and light direction. The program uses data, which is obtained about such locations a priori while using the user control device 12 by a user.

At the time of feeding the main control device 10 with data about lighting conditions at locations covered by the lighting arrangements 2 the user uses the user control device 12 to receive light at each of said locations from any lighting arrangement 2 covering the location, deriving an identification code, of a single lighting arrangement 2 or, in case of receiving composite direct or indirect light from several lighting arrangements 2, several identification codes originating from respective lighting arrangements 2. The user control device measures some property of the received light of interest, apart from representing data, such as average light intensity during some interval. Then, the user control device 12 transmits data, which represents a value of a measured light property together with one or more derived identification codes, to the main control device 10. Then, the program of the main control device 10 can determine the influence or effect a specific control of the main control device 10 has on the lighting at the current location of the user control device 12. Having gained data on several locations, the main control device 10 can control the lighting arrangements 2 in several ways to obtain wanted light effects in some or all of said locations.

According to the invention a location of the user control device 12 is determined to provide location data, which the main control device 10 takes in account when controlling a lighting arrangement 2 or lighting arrangements 2. The location of the user control device 12 can be determined in different ways. For example, the user control device 12 can determine its location itself, such as by using GSM or by monitoring its position with respect to reference objects, which are located in the room or other area covered by the lighting system and which may be transmitter for transmitting modulated light or ultrasound. As an alternative, the main control device 10 can determine the location of the user control device 12. For example, the user control device 12 may be provided with a transmitter for transmitting light or ultrasound and the main control device may comprise, or may be connected to, several receivers at different reference locations for receiving such light or sound to therefrom calculate the position of the user control device 12. Such means are well known to persons skilled in this art and are not part of the invention per se. Therefore a detailed description thereof is omitted here. For the same reason a detailed description of means for modulating light by data, in particular an identification code, means for receiving such modulated light and deriving data therefrom is omitted here.

Figure 2:
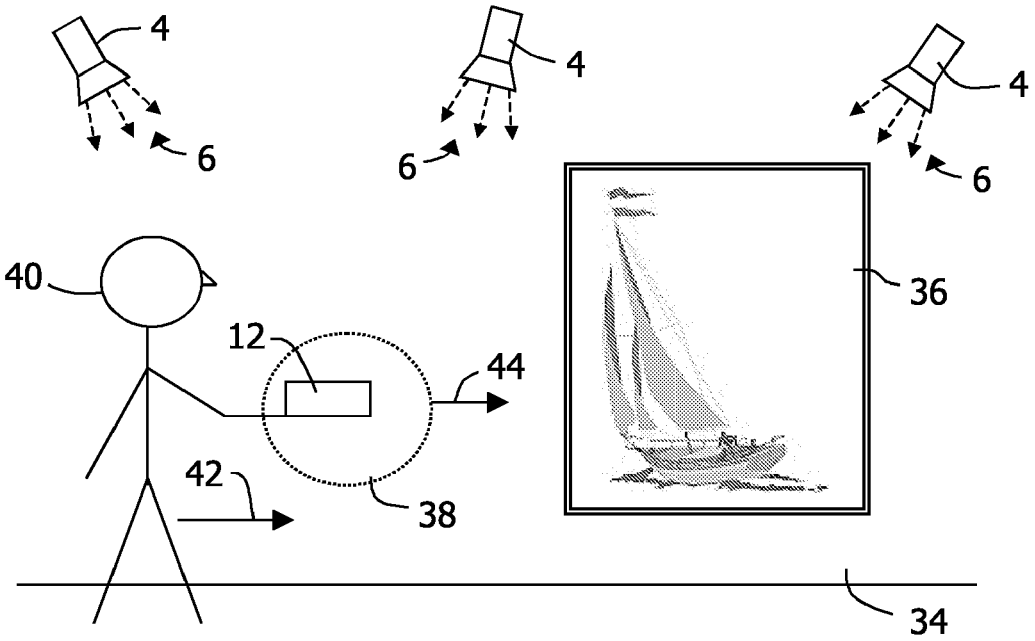
FIG. 2 shows diagrammatically an example of practicing the method and system according to the invention.

In FIG. 2 reference numeral 34 indicates a wall, such as a wall of an exhibition room. A painting 36 is attached to the wall 34. The painting 36 and other exhibition objects (not shown) can be lighted by several lighting units 4 of one or more lighting arrangements 2. Preferably, each lighting unit 4 is equipped with means for dimming, directing and focusing light emitted by the lighting unit 4.

In the example of FIG. 2 the lighting units 4 are in such states, as controlled by the main control device 10, that they generate a specific light effect, such as a light spot 38, at some location at the wall 34. A user 40 carries the user control device 12, such that the user control device may receive light from lighting units 4. The user 40 may control a user interface (not shown in detail), such as a button, of the user control device 12 to instruct the main control device 10 to determine current data about the light received by the user control device 12, identification codes of lighting arrangements the light originates from, and data about the location of the user control device 12. Further, by operating said user interface the user 40 may instruct the main control device 10 also to track the user control device 12 when it moves and to keep determining said data when the user control device 12 moves. This way the main control device may learn about lighting effects in three dimensions resulting from light which is emitted by one or more lighting units 4 associated with specific states of control of the lighting units 4 by the main control device 10. Thus, the main control device 10 may learn about which light effects it may create by which ways of control it may do so.

In addition, the user 40 may instruct the main control device 10 to not only track the user control device 12 when it moves, but also to control the lighting arrangements 2 or their lighting units 4 such as to maintain a light effect at the changing location of the user control device 12. As a result, the light effect is dragged by the user control device 12 to any other location. That is, provided that the main control device 10 has been provided a priori, such as by the learning process described above, with data about the way or ways it may change control of the lighting arrangements 2 to maintain said light effect at a changing location of the user control device 12. This way the user 40, when moving in a direction as indicated by arrow 42, may drag the light spot 38 along a track indicated by arrow 44 from the wall 34 outside the painting 36 towards a specific detail of the painting 36. The user 40 needs not to know how the main control device 10 controls the lighting arrangements 2 to achieve such dragging. The user may fully concentrate on the light scheme of the exhibition he wants to create.

Figure 3:
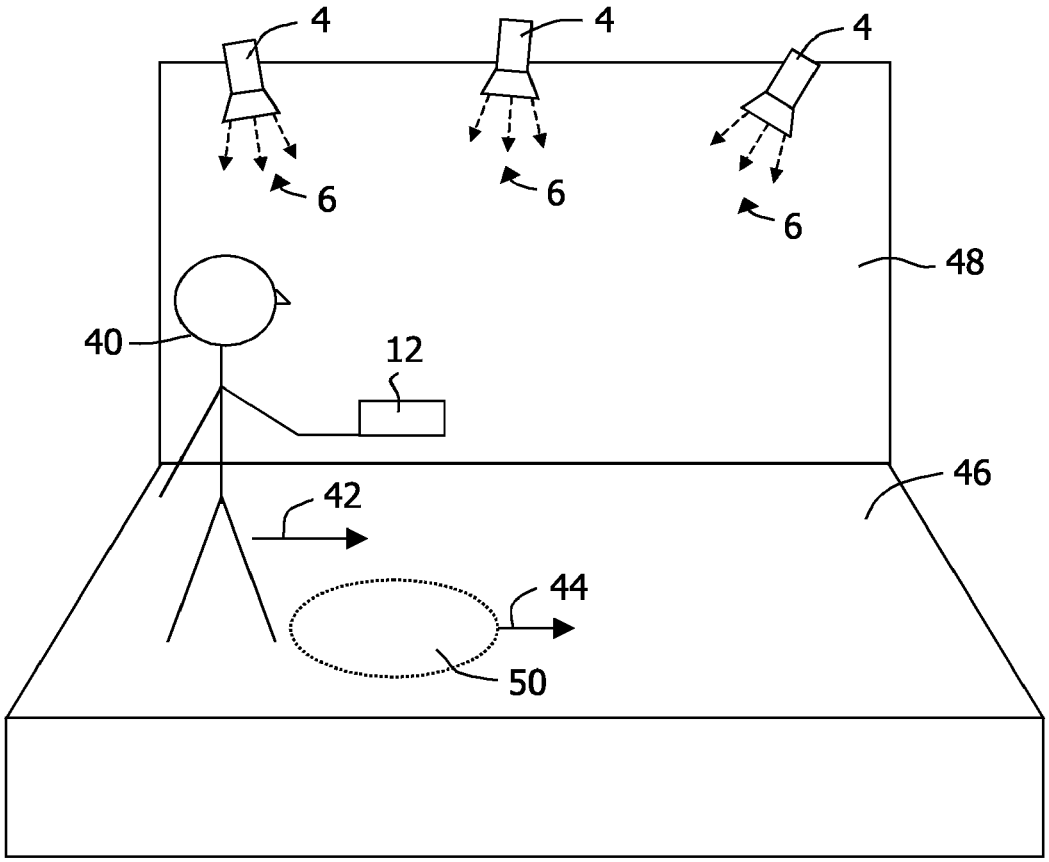
FIG. 3 shows diagrammatically another example of practicing the method and system according to the invention.

In FIG. 3 reference numeral 46 indicates a stage and reference numeral 48 indicates a back wall. In the situation as indicated lighting units 4 are in states in which they produce a specific light effect, such as a light spot 50, on the stage 46. Similar to the example of FIG. 2 the user 40 may instruct the main control device 10 to track the user control device 12 when it moves, to gain data about a light effect as determined by the user control device as it moves, and to maintain said light effect at a changing location of the user control device 12 as it moves by properly controlling the lighting arrangements 2. This way a director may easily create an attractive lighting scheme for a performance which is to be made on said stage 46.

With the method and system according to the invention means are obtained by which lighting effects, which are a result of controlling lighting arrangements in specific locations, can be determined via an user control device 12 and communicated to the main control device 10 to therewith control the lighting arrangements 2, in any of several possible ways to obtain wanted light effects in said locations and dependent on a location of the user control device 12. The method and system according to invention allow to provide the main control device easily with data about possible lighting effects in several locations and about several alternative ways to produce the light effects. In addition, the method and system according to the invention allow to drag a specific light effect at a specific location to be dragged to another location, just by moving the user control device 12.

It is noted that several modifications can be carried out without departing from the scope of the invention as determined by the amended claims. For example, the data which a lighting arrangement 2 uses to modulate light may comprise data about properties or specifications of the lighting arrangement 2. This additional data can be relayed through the user control device 12 together with the identification code of the lighting arrangement 2 to the main control device 10. Then, the main control device 10 can take said additional data in account when controlling the operation of said lighting arrangement 2 or lighting arrangements 2. Said additional data may refer to capacities about color dependent light intensities, and light directional information.

It is also observed that, within the scope of the appended claims, monitoring, tracking and dragging a light effect does not require, for example, to hold a button of the user control device 12 pushed down. It is also possible to "copy", "memorize", "paste" and "scroll" a light effect which is detected at some location. Pasting and scrolling include transmitting an alternative location from the user control device 12 to the main control device 10. Operating one or more buttons and/or a scroll wheel of the user control device 12 by the user may initiate such transmission of an alternative location. Handling commands like this by the main control device 10 is not much different from handling similar commands supplied by operating a computer mouse. Therefore, method steps or software for handling such commands are omitted in this description.

The invention claimed is:

1. A method for controlling a lighting system, which comprises a lighting arrangement, a user controlled device and a main control device, the method comprising the acts of:

providing the lighting arrangement with an identification code;

at the lighting arrangement:

modulating light emitted by the lighting arrangement by lighting arrangement data, the lighting arrangement data containing the identification code of the lighting arrangement;

at the user controlled device:

receiving the light from the lighting arrangement;

deriving the received lighting arrangement data from the light received from the lighting arrangement;

generating by a user interface additional data which is associated with the identification code contained in the received lighting arrangement data;

transmitting the received lighting arrangement data and the additional data;

at the main control device:

receiving the lighting arrangement data and the additional data from the user controlled device;

controlling operation of the lighting arrangement dependent on the received lighting arrangement data and the additional data;

wherein the user controlled device determines at least one property of the received light, apart from any identification code contained therein, to provide light property data, a location of the user controlled device to provide location data, and light tracking commands from a user to provide tracking command data, and wherein the user controlled device transmits the identification code, the additional data, the light property data, the location data and the tracking command data to the main control device, and the main control device controls the lighting arrangement in accordance with the identification code, the additional data, the light property data, the location data and the tracking command data.

2. The method according to claim 1, wherein a further light property, apart from an identification code, is determined at the lighting arrangement to provide further light property data, which is transmitted by modulating the light emitted by the lighting arrangement, and the user controllable device relays the further light property data to the main control device.

3. The method according to claim 1, wherein the at least one light property, apart from an identification code, is determined at the user controllable device by measuring the light for said at least one light property.

4. The method according to claim 1, wherein dependent on the light property data, the location data and the tracking command data received by the main control device, the main control device controls the lighting arrangement to maintain a lighting effect, which said lighting arrangement has at a location of the user controllable device.

5. The method according to claim 1, wherein before controlling said lighting arrangement, the main control device is provided with a priori data about a lighting effect said lighting arrangement has at several locations, and during said controlling, the main control device takes said a priori data in account.

6. The method according to claim 1, wherein before controlling said lighting arrangement, the main control device is provided with a priori data about an environment which can be lighted by said lighting arrangement, and during said controlling, the main control device takes said a priori data in account.

7. The method of claim 1, wherein the at least one property includes at least one of intensity of a composite of light received by the user controlled device, intensities of light of different colors of the light received by the user controlled device, and emission directions of the light received by the user controlled device.

8. The method of claim 1, wherein the central control device receives specification of the lighting arrangement, the specification including power, time and temperature dependent light emission from the lighting arrangement, the central control device taking the specification in account for controlling the lighting arrangement concurrent with controlling further lighting arrangements to provide a light effect having the at least one light property determined by the user controlled device, the user controlled device being configured to drag the lighting effect to further locations upon being located at the further locations.

9. The method of claim 8, wherein the lighting effect comprises a light spot having the at least one light property determined by the user controlled device.

10. The method of claim 1, wherein the central control device is configured to control the lighting arrangement to provide light having the at least one property to a further location upon moving the user controlled device to the further location.

11. The method of claim 10, wherein the user controlled device determines the at least one property by measuring the light received by a sensor of the user controlled device.

12. The method of claim 1, wherein the user controlled device is configured to issue a track command to the central control device to track movement of the user controlled device and to maintain a lighting effect at changed locations of the user controlled device.

13. A lighting system, comprising:

a lighting arrangement having a modulator to modulate a light output of the lighting arrangement by lighting arrangement data, which contains an identification code of the lighting arrangement;

a user controlled device having a receiver to receive light including the lighting arrangement data from the lighting arrangement and a transmitter to transmit the received lighting arrangement data contained in the received light and additional data generated by a user interface, the additional data being associated with the identification code contained in the received lighting arrangement data; and a main control device having a main receiver to receive data transmitted by the user controlled device including the lighting arrangement data and the additional data, and to control operation of the lighting arrangement dependent on the data received from the user controlled device, wherein the user controlled device comprises a sensor to determine at least one property of the received light, apart from any identification code contained therein, and to provide light property data, the user interface receiving light tracking commands from a user to provide tracking command data to the main control device, the user controlled device being configured to determine a lighting location of the lighting arrangement and a device location of the user controlled device to provide location data, wherein the user controlled device transmits data to the main control device, the transmitted data including the identification code, the additional data, the lighting location, the device location and the light property data, and the main control device controls the lighting arrangement in accordance with the transmitted data.

14. The lighting system according to claim 13, wherein the main control device contains a control program, which, dependent on the transmitted data, controls the lighting arrangement to maintain a lighting effect, which said lighting arrangement has on the user controlled device.

15. The lighting system according to claim 14, wherein the control program, before controlling said lighting arrangement, is supplied with a priori data about a lighting effect said lighting arrangement has at several locations, and during said controlling the control program takes said a priori data in account.

16. The lighting system according to claim 14, wherein the control program, before controlling said lighting arrangement, is supplied with a priori data about an environment which can be lighted by said lighting arrangement, and during said controlling the control program takes said a priori data in account.

17. The lighting system of claim 13, wherein the main control device receives specification of the lighting arrangement, the specification including power, time and temperature dependent light emission from the lighting arrangement, the main control device taking the specification in account for controlling the lighting arrangement concurrent with controlling further lighting arrangements to provide a light effect having the at least one light property determined by the user controlled device, the user controlled device being configured to drag the lighting effect to further locations upon being located at the further locations.

18. The lighting system of claim 13, wherein the main control device is configured to control the lighting arrangement to provide light having the at least one property to a further location upon moving the user controlled device to the further location.

19. The lighting system of claim 18, wherein the user controlled device determines the at least one property by measuring the light received by a sensor of the user controlled device.

20. The lighting system of claim 13, wherein the user controlled device is configured to issue a track command to the main control device to track movement of the user controlled device and to maintain a lighting effect at changed locations of the user controlled device.

* * * * *